US011235443B2

(12) United States Patent
Harvey et al.

(10) Patent No.: US 11,235,443 B2
(45) Date of Patent: Feb. 1, 2022

(54) PIPE WRENCH

(71) Applicant: Milwaukee Electric Tool Corporation, Brookfield, WI (US)

(72) Inventors: Kyle Harvey, Wauwatosa, WI (US); Jesse Marcelle, Muskego, WI (US); Cheng Zhang Li, Sussex, WI (US); James A. Cemke, Jr., Richfield, WI (US); Andrew G. Wagner, Lisbon, WI (US); Timothy Janda, Elkhorn, WI (US); Eric Mackey, Milwaukee, WI (US); Steven W. Hyma, Milwaukee, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 1503 days.

(21) Appl. No.: 14/835,767

(22) Filed: Aug. 26, 2015

(65) Prior Publication Data

US 2015/0360351 A1 Dec. 17, 2015

Related U.S. Application Data

(63) Continuation-in-part of application No. 14/226,221, filed on Mar. 26, 2014.

(Continued)

(51) Int. Cl.

| | |
|---|---|
| ***B25B 13/50*** | (2006.01) |
| ***B25G 1/04*** | (2006.01) |
| ***B25B 13/14*** | (2006.01) |

(52) U.S. Cl.

CPC ..... *B25B 13/5058* (2013.01); *B25B 13/14* (2013.01); *B25G 1/043* (2013.01)

(58) Field of Classification Search

CPC .. B25B 13/5025; B25B 13/5058; B25G 1/043

(Continued)

(56) References Cited

U.S. PATENT DOCUMENTS

| | | | |
|---|---|---|---|
| 59,852 | A | 11/1866 | McLaren |
| 179,276 | A | 6/1876 | Crosby |

(Continued)

FOREIGN PATENT DOCUMENTS

| | | |
|---|---|---|
| CN | 2726826 | 9/2005 |
| CN | 201102213 | 8/2008 |

(Continued)

OTHER PUBLICATIONS

Internet publication; "https://www.lowes.com/search?searchTerm=pipe+wrench", results for different pipe wrenches available at known national retailer (Year: 2018).*

(Continued)

*Primary Examiner* — Bryan R Muller

(74) *Attorney, Agent, or Firm* — Reinhart Boerner Van Deuren s.c.

(57) ABSTRACT

A pipe wrench includes a head having a first aperture defining a central axis. The pipe wrench includes a first jaw coupled to the head having a plurality of teeth defining a first contact region, and a second jaw partially extending through the aperture of the head having a threaded portion and a plurality of teeth defining a second contact region. The second contact region extends beyond the first contact region in a direction parallel to side surfaces of the head. The pipe wrench includes a biasing mechanism located within the first aperture to align the threaded portion of the second jaw with the central axis of the first aperture, and an actuator having threads engaged with the threaded portion of the second jaw such that rotation of the actuator moves the (Continued)

second contact region of the second jaw relative to the first contact region of the first jaw.

12 Claims, 15 Drawing Sheets

Related U.S. Application Data

(60) Provisional application No. 61/805,422, filed on Mar. 26, 2013, provisional application No. 62/180,255, filed on Jun. 16, 2015, provisional application No. 62/042,602, filed on Aug. 27, 2014, provisional application No. 62/094,465, filed on Dec. 19, 2014.

(58) Field of Classification Search
USPC ..... 81/186
See application file for complete search history.

(56) References Cited

U.S. PATENT DOCUMENTS 461,769 A 10/1891 Patton
467,151 A 1/1892 Carpenter
483,785 A 10/1892 Hilts
592,031 A 10/1897 Waitt
869,097 A 10/1907 Mandi
954,335 A 4/1910 Page
966,300 A 8/1910 Bennett
992,127 A 5/1911 Hachmann
998,271 A 7/1911 Barabe
1,000,724 A 8/1911 Duffey
1,032,035 A 7/1912 Ver Beck
1,074,936 A 10/1913 Evans
1,129,771 A 2/1915 Wolfe
1,163,233 A 12/1915 Haban
1,204,999 A 11/1916 McCord
1,209,002 A 12/1916 Martin
1,288,248 A 12/1918 Snowdon
1,334,392 A 3/1920 Lumpkin
1,345,983 A 7/1920 Bell
1,353,246 A 9/1920 Kiefer
1,356,577 A 10/1920 Wiertz
1,362,845 A 12/1920 Carr
1,380,052 A 5/1921 Fowble
1,395,952 A 11/1921 Fraro
1,449,386 A 3/1923 Evans et al.
1,492,478 A 4/1924 Markovich
1,504,870 A 8/1924 Coughlin
1,542,123 A 6/1925 Eifel
1,563,242 A 11/1925 Tweit
1,565,338 A 12/1925 Thewes
1,589,736 A 6/1926 Bell
1,589,763 A 6/1926 Ratcliff
1,599,399 A 9/1926 Bjornson et al.
1,652,355 A 12/1927 Hammer
1,662,002 A 3/1928 Dowd
1,697,764 A 1/1929 Heinz
1,727,623 A * 9/1929 Thewes ..... B25B 13/5058 81/101
1,862,002 A 6/1932 Brungardt
2,063,318 A 12/1936 Larson
2,076,830 A 4/1937 Thewes
2,116,743 A 5/1938 Henderson
2,192,702 A 3/1940 Wright
2,282,148 A * 5/1942 Mandl ..... B25G 1/043 16/422
2,302,633 A 11/1942 Ingwer et al.
2,483,713 A * 10/1949 Seaver ..... B25B 13/5058 269/60
2,502,407 A 3/1950 Gordon
2,517,729 A 8/1950 Smith
2,528,814 A 11/1950 Boyer
2,650,512 A 9/1953 Johnson et al.
2,691,317 A 10/1954 Olson
2,696,133 A * 12/1954 Burgess ..... B25B 13/10 81/100
2,700,911 A 2/1955 Dyczynski
2,748,641 A * 6/1956 Calello ..... B25B 7/02 269/282
2,813,443 A 11/1957 St. Pierre
2,825,254 A * 3/1958 Peltcher ..... B25B 13/481 81/165
3,657,949 A 4/1972 Myers
3,802,466 A 4/1974 Panella
3,956,949 A 5/1976 Romano
3,996,820 A 12/1976 Tuell
4,541,313 A 9/1985 Wise
4,572,037 A 2/1986 Jeng-Shyong
4,580,468 A * 4/1986 Cox ..... B25B 13/22 81/138
4,597,315 A 7/1986 Chen
4,794,829 A 1/1989 Mesenhoeller
4,831,903 A * 5/1989 Dausey ..... B25B 13/16 81/165
4,903,555 A * 2/1990 Howard ..... B25B 13/12 81/137
5,152,198 A 10/1992 Schmitz, Jr.
5,251,518 A 10/1993 Woo
5,331,868 A 7/1994 Elmore
5,392,673 A * 2/1995 Scott ..... B25G 1/043 81/177.2
5,517,884 A 5/1996 Sanders
5,535,649 A * 7/1996 Waggle, Jr. ..... B25G 1/005 81/177.2
5,542,319 A 8/1996 Wei
5,823,076 A 10/1998 Binkowski
5,832,793 A 11/1998 Collins
5,862,722 A 1/1999 Cislo
5,927,159 A 7/1999 Yokoyama et al.
5,957,008 A 9/1999 Long
5,960,683 A 10/1999 Malkin et al.
6,026,714 A 2/2000 Chang
6,089,129 A 7/2000 Huang
6,098,505 A 8/2000 Chang
6,131,491 A 10/2000 Hirse
D435,410 S 12/2000 Lin
6,167,784 B1 1/2001 Lin
6,223,632 B1 5/2001 Johnson
6,257,102 B1 7/2001 Perry
6,298,754 B1 10/2001 Brown
6,305,251 B1 10/2001 Pasbrig
6,311,586 B1 11/2001 Hirse
6,334,377 B1 1/2002 Wu
6,336,381 B2 1/2002 McDonnell
6,349,621 B1 2/2002 Khachatoorain
6,378,400 B1 4/2002 Bogli
6,393,951 B1 5/2002 Jansson et al.
6,431,033 B1 8/2002 Cheng
6,477,921 B1 11/2002 Picone
D474,380 S 5/2003 Chartier et al.
6,568,283 B2 5/2003 Fanguy
D483,238 S 12/2003 Hsich
6,742,419 B2 6/2004 Chartier et al.
D494,030 S * 8/2004 Burry ..... D8/22
6,810,775 B2 11/2004 Yang
6,931,969 B2 8/2005 Hsien
6,938,525 B2 9/2005 Poole et al.
6,961,973 B1 11/2005 Smith
6,966,242 B2 11/2005 Picone
6,971,288 B2 12/2005 Wei
7,040,199 B2 * 5/2006 Gregory ..... B25B 13/5058 81/159
7,044,030 B2 5/2006 Chartier et al.
7,059,221 B2 6/2006 Simon
7,096,764 B2 8/2006 Dong
7,114,824 B2 10/2006 Picone
7,131,355 B2 11/2006 Williams
D546,148 S 7/2007 Becker
D564,848 S 3/2008 Salazar et al.
D571,172 S 6/2008 Yu
7,472,630 B1 1/2009 Velluzzi
7,546,784 B1 6/2009 Yu

(56) References Cited

U.S. PATENT DOCUMENTS

| | | | | |
|---|---|---|---|---|
| 7,578,219 | B2 | 8/2009 | Wu | |
| 7,882,768 | B2 | 2/2011 | Urquizu Osa | |
| D657,213 | S | 4/2012 | Pond et al. | |
| 8,176,816 | B2 | 5/2012 | Simon | |
| D676,727 | S | 2/2013 | Martin et al. | |
| 8,549,961 | B2 | 10/2013 | Huang | |
| 9,610,676 | B2 * | 4/2017 | Kundracik | B25B 13/5041 |
| 2001/0035076 | A1 | 11/2001 | Gilbert | |
| 2003/0015068 | A1 | 1/2003 | Pool et al. | |
| 2003/0110905 | A1 | 6/2003 | Lacey | |
| 2003/0183048 | A1 | 10/2003 | Olsen | |
| 2004/0237731 | A1 | 12/2004 | Ha | |
| 2005/0204873 | A1 * | 9/2005 | Ana | B25G 1/005 81/177.2 |
| 2005/0243553 | A1 | 11/2005 | Picone | |
| 2006/0053982 | A1 | 3/2006 | Mo | |
| 2006/0196319 | A1 | 9/2006 | Hung et al. | |
| 2007/0074608 | A1 | 4/2007 | Mo | |
| 2007/0125205 | A1 | 6/2007 | Beckwith et al. | |
| 2007/0245861 | A1 | 10/2007 | Shields | |
| 2008/0276762 | A1 * | 11/2008 | Dein | B25B 13/461 81/59.1 |
| 2009/0193940 | A1 | 8/2009 | Kuo | |
| 2009/0217790 | A1 | 9/2009 | Harter | |
| 2010/0050825 | A1 | 3/2010 | May | |
| 2010/0122612 | A1 | 5/2010 | Kovach et al. | |
| 2010/0083798 | A1 | 8/2010 | Tai | |
| 2010/0242686 | A1 | 9/2010 | Gower | |
| 2011/0232427 | A1 | 9/2011 | Streater et al. | |
| 2013/0180367 | A1 | 7/2013 | Wang | |
| 2013/0327186 | A1 | 12/2013 | Harvey | |
| 2014/0007744 | A1 | 1/2014 | Watson et al. | |
| 2014/0069238 | A1 | 3/2014 | Chang | |
| 2014/0083260 | A1 | 3/2014 | Kundracik et al. | |
| 2014/0116206 | A1 | 5/2014 | Chartier et al. | |
| 2015/0000476 | A1 | 1/2015 | Li | |

FOREIGN PATENT DOCUMENTS

| | | |
|---|---|---|
| CN | 101268245 A | 9/2008 |
| CN | 201511326 | 6/2010 |
| CN | 204431137 | 7/2015 |
| DE | 202006018047 | 3/2007 |
| GB | 711231 | 6/1954 |
| GB | 753198 | 7/1956 |
| JP | 06021856 | 3/1994 |
| TW | 234970 | 11/1994 |
| TW | 309827 | 7/1997 |
| TW | 451783 | 8/2001 |
| TW | 493505 | 7/2002 |
| TW | 501520 | 9/2002 |
| TW | M311538 | 5/2007 |
| TW | M344224 | 11/2008 |
| TW | M440851 | 11/2012 |
| TW | M465252 | 11/2013 |
| TW | M471338 | 2/2014 |
| WO | 9740964 | 11/1997 |
| WO | WO9821010 | 5/1998 |

OTHER PUBLICATIONS

Internet Publication; "https://smile.amazon.com/Grizzly-H6271-Steelex-10-Inch-14-Inch/dp/B0007D2YU4/ref=sr_1_12?keywords=pipe+wrench+set&qid=1562104228&s=gateway&sr=8-12"; Grizzly Pipe Wrench set (Year: 2016).*

Internet Publication; "https://www.amazon.com/Titan-Tools-21304-4-Piece-Wrench/dp/B00TU3UNPK"; Titan Tools Pipe Wrench Set (Year: 2015).*

Australian Examination Report No. 3 for Application No. 2014241257 dated Oct. 9, 2017 (7 pages).

Taiwan Patent Office Search Report for Application No. 105136020 dated Sep. 18, 2017 (2 pages).

International Search Report and Written Opinion for Application No. PCT/US2015/046847 dated Dec. 12, 2015 (5 pages).

Extended European Search Report for Application No. 14775769.4 dated Feb. 24, 2017 (10 pages).

International Search Report and Written Opinion for Application No. PCT/US2014/031880 dated Aug. 29, 2014 (16 pages).

International Preliminary Report on Patentability for Application PCT/US2014/031880 dated Oct. 8, 2015 (13 pages).

Australian Examination Report No. 2 for Application No. 2014241257 dated Mar. 24, 2017 (6 pages).

* cited by examiner

PIPE WRENCH

CROSS-REFERENCE TO RELATED APPLICATIONS

This application is a continuation-in-part of and claims priority to co-pending U.S. patent application Ser. No. 14/226,221, filed Mar. 26, 2014, which claims priority to U.S. Provisional Patent Application No. 61/805,422, filed Mar. 26, 2013, the entire contents of all of which are herein incorporated by reference.

This application also claims priority to U.S. Provisional Patent Application No. 62/180,255, filed Jun. 16, 2015, U.S. Provisional Patent Application No. 62/094,465, filed Dec. 19, 2014, and U.S. Provisional Patent Application No. 62/042,602, filed Aug. 27, 2014 the entire contents of all of which are herein incorporated by reference.

BACKGROUND

The present invention relates to wrenches, and more particularly to pipe wrenches.

Pipe wrenches are typically used to rotate, tighten, or otherwise manipulate pipes, valves, fittings, and other plumbing components. Some types of pipe wrenches include a fixed jaw and a hook jaw movable with respect to the fixed jaw to adjust the spacing between the jaws. Because pipe wrenches are often used to apply torque to round work pieces, the jaws typically include teeth for improved grip.

SUMMARY

In one embodiment, a pipe wrench includes a head having a first aperture, a first jaw coupled to the head having a plurality of teeth that define a first contact region, and a second jaw partially extending through the aperture of the head having a threaded portion and a plurality of teeth that define a second contact region. The second contact region extends beyond the first contact region in a direction parallel to side surfaces of the head. The second contact region defines a width. The pipe wrench also includes an actuator having threads engaged with the threaded portion of the second jaw such that rotation of the actuator moves the second contact region of the second jaw relative to the first contact region of the first jaw, and an extension handle removably coupled to the head. The extension handle and the second jaw define a length. A ratio of the width of time second contact region and the length is less than about 0.1.

In another embodiment, a pipe wrench includes a head having a first aperture, a first jaw coupled to the head having a plurality of teeth that define a first contact region, a second jaw partially extending through the aperture of the head having a threaded portion and a plurality of teeth that define a second contact region, an actuator having threads engaged with the threaded portion of the second jaw such that rotation of the actuator moves the second contact region of the second jaw relative to the first contact region of the first jaw, and a handle having a proximal end portion and a distal end portion. The distal end portion is adjacent the head and the proximal end portion is opposite the distal end portion. The proximal end portion includes a bore. The pipe wrench also includes a first extension handle selectively coupled within bore.

In still another embodiment, a pipe wrench includes a head having a first aperture defining a central axis. The pipe wrench includes a first jaw coupled to the head having a plurality of teeth defining a first contact region, and a second jaw partially extending through the aperture of the head having a threaded portion and a plurality of teeth defining a second contact region. The second contact region extends beyond the first contact region in a direction parallel to side surfaces of the head. The pipe wrench includes a biasing mechanism located within the first aperture to align the threaded portion of the second jaw with the central axis of the first aperture, and an actuator having threads engaged with the threaded portion of the second jaw such that rotation of the actuator moves the second contact region of the second jaw relative to the first contact region of the first jaw.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
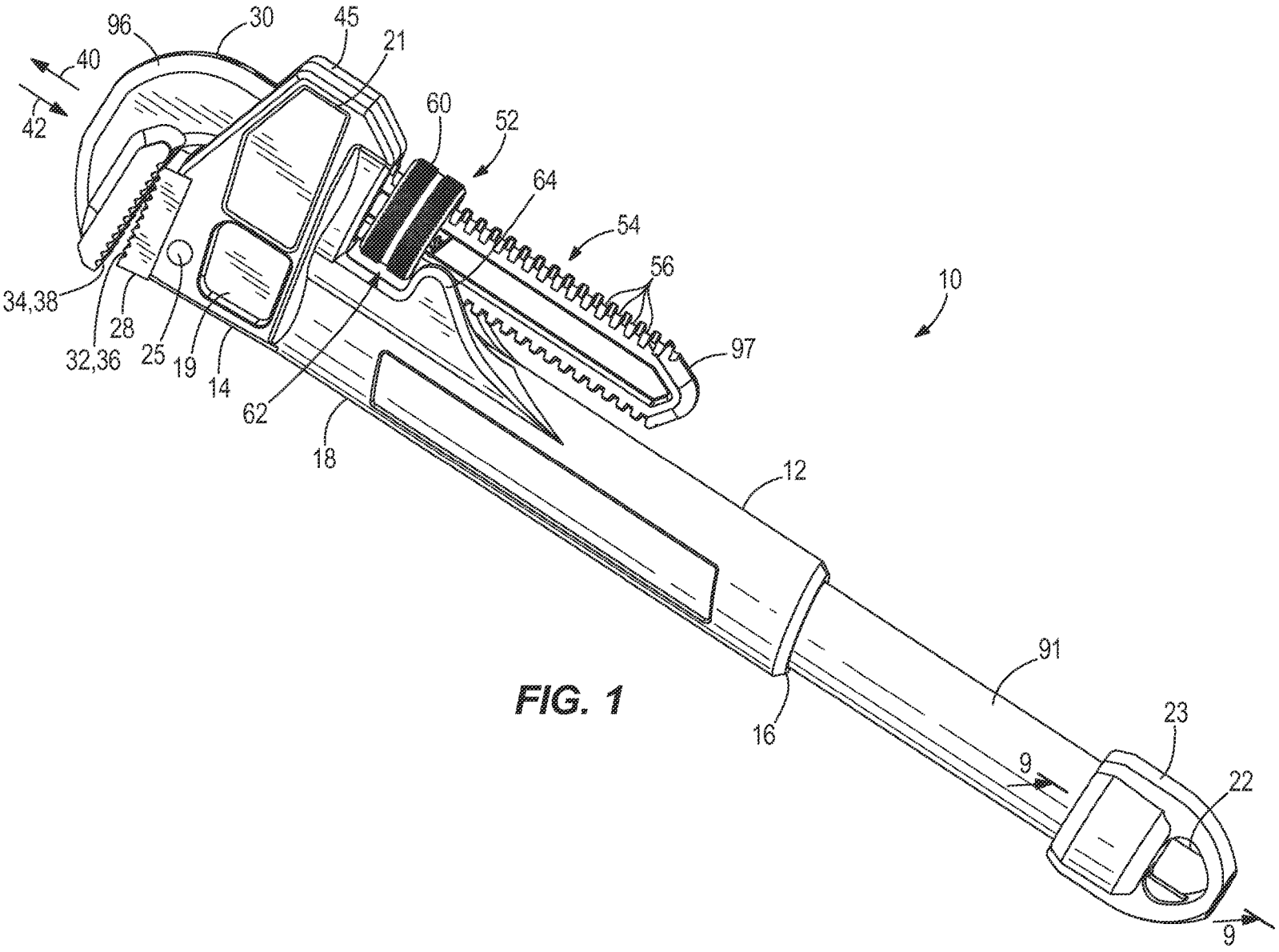
FIG. 1 is a front perspective view of a wrench according an embodiment of the invention.

FIG. 1 illustrates a wrench 10 according to an embodiment of the invention. The wrench 10 includes a handle 12 and a head 14. The handle 12 is an elongated cylindrical member having a proximal end portion 16 and a distal end portion 18 that is adjacent the head 14. In addition, the handle 12 is integrally formed with the head 14 as a single component. The handle 12 defines a bore 13 (FIG. 6) with internal threads 15 adjacent the distal end portion 18. The head 14 includes recessed portions 19 located on opposite side surfaces of the head 14 defining a quantity of material that has been removed from the head 14. Stated another way, a first recessed portion 19 is located on a first side surface of the head 14, and a second recessed portion 19 is located on a second side surface of the head 14. The illustrated head 14 also includes a second recessed portion 21 adjacent one of the recessed portions 19. In other embodiments, the head 14 may include two second recessed portions 21 located on opposite sides of the head 14. The head 14 also includes a generally planar surface 45 usable as a hammering surface located on a rear surface of the head 14. In particular, the wrench 10 is operable as a hammer in that the planar surface 45 strikes an object (e.g., a work piece), or the wrench 10 is operable as an anvil surface in that an object (e.g., a hammer) strikes the planar surface 45. In the illustrated embodiment, the handle 12 and the head 14 are made from a metallic material (e.g., ductile iron).

Figure 2:
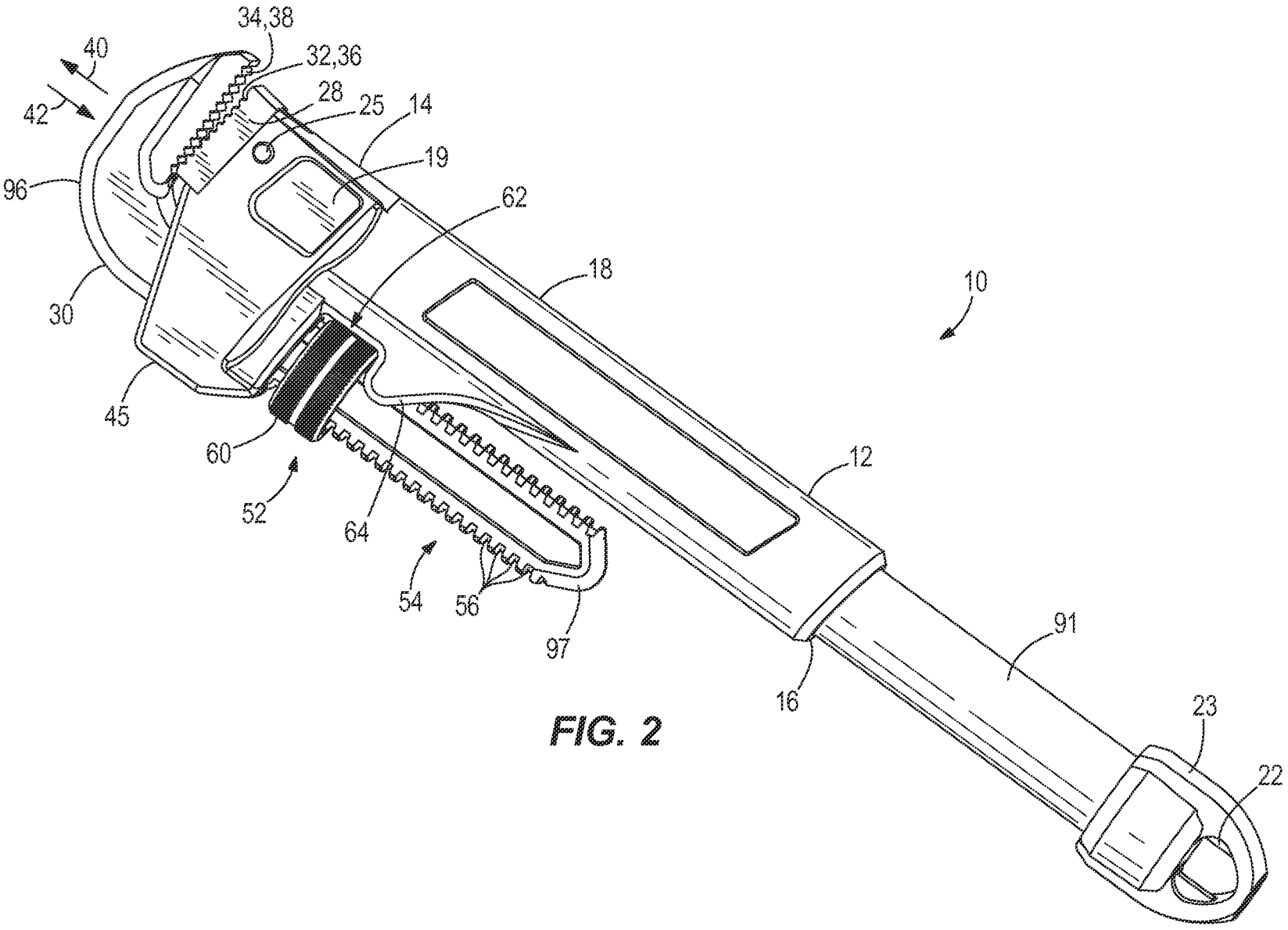
FIG. 2 is a back perspective view of the wrench of FIG. 1.
Figure 3:
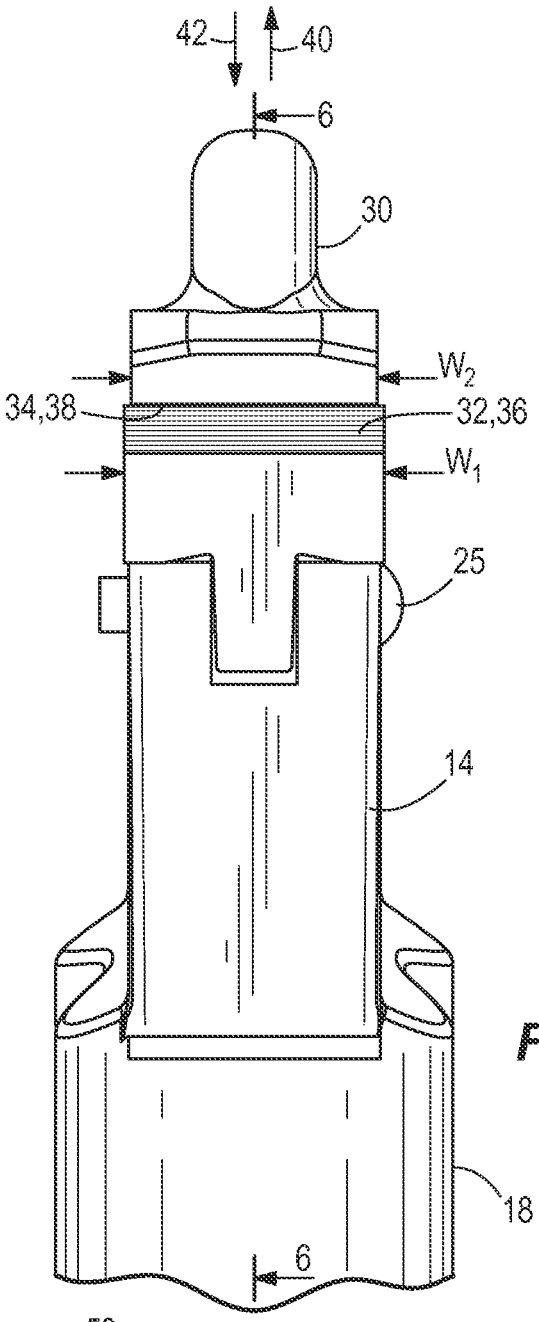
FIG. 3 is a partial front view of the wrench of FIG. 1.
Figure 6:
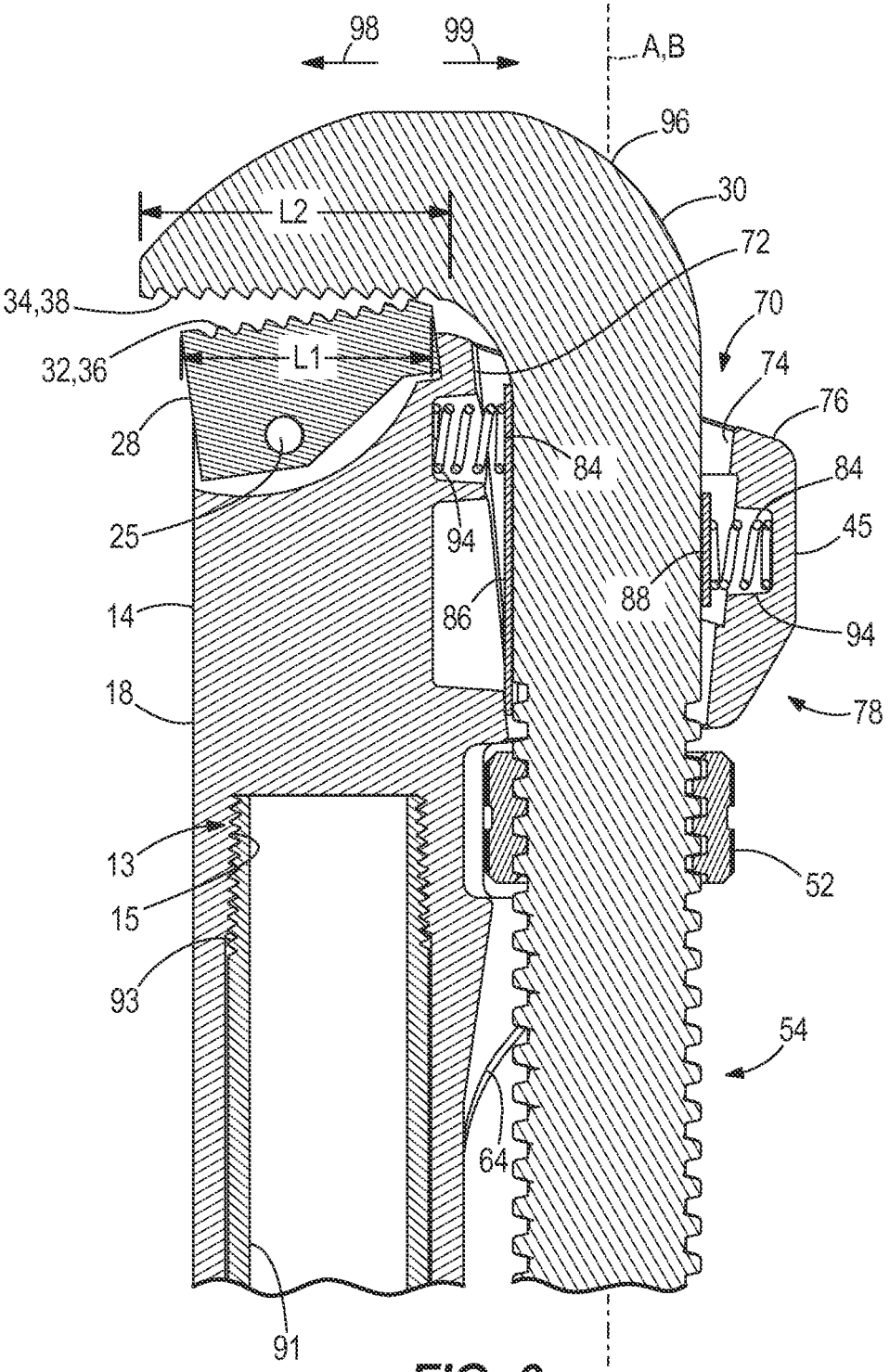
FIG. 6 is a cross-sectional view taken along 6-6 of the wrench of FIG. 3 including a hook jaw in a first position.
Figure 7:
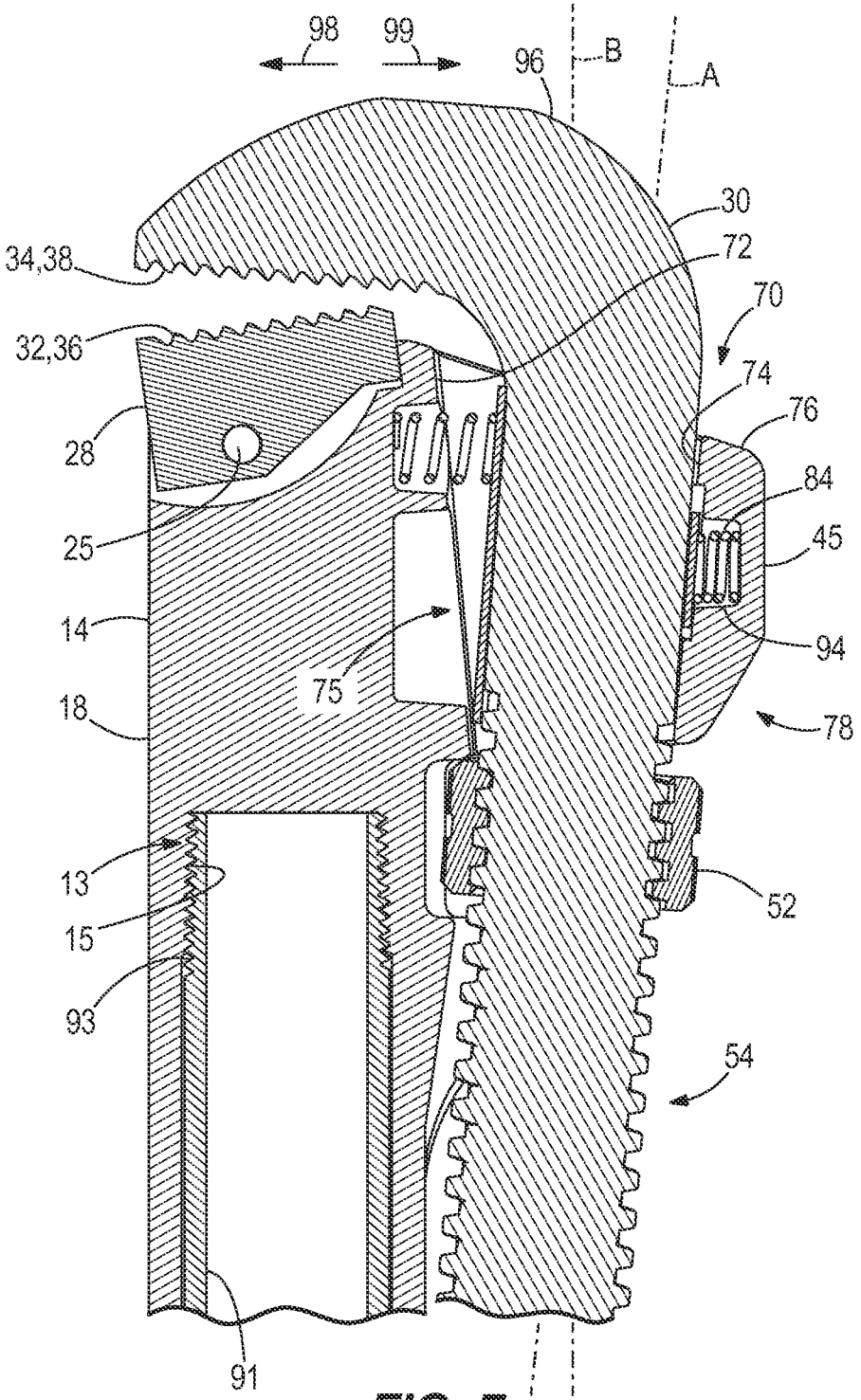
FIG. 7 is a cross-sectional view taken along 6-6 of the wrench of FIG. 3 including the hook jaw in a second position.

With reference to FIGS. 1 and 2, the wrench 10 includes a first or fixed jaw 28, and a second or hook jaw 30. In the illustrated embodiment, the fixed jaw 28 is removably coupled to the head 14 via a pin 25 so that the fixed jaw 28 can be replaced when it becomes worn. In one embodiment, the pin 25 allows the fixed jaw 28 to pivot relative to the head 14. In other embodiments, the fixed jaw 28 can be permanently fixed to the head 14. The fixed jaw 28 and the hook jaw 30 each include a plurality of teeth 32, 34 that define contact regions 36 and 38, respectively. With reference to FIGS. 3 and 6, the plurality of teeth 32 includes a width $W_1$ extending from one recessed portions 19 (e.g., a first side surface of the head 14) to the other recessed portion (e.g., a second side surface of the head 14) and a length $L_1$ extending parallel to the recessed portions 19 (e.g., parallel to the first and the second side surfaces). In the illustrated embodiment, the width $W_1$ is about 0.9 inches and the length $L_1$ is about 1.3 inches. In other embodiments, the width $W_1$ may be about 0.7 inches to about 1.3 inches, and/or the length $L_1$ may be about one inch to about 1.8 inches.

The hook jaw 30 is movable relative to the fixed jaw 28 generally in directions of arrows 40 and 42, to increase or decrease a distance 44 (FIG. 4) between the jaws 28 and 30 (i.e., the perpendicular distance between the contact regions 36 and 38) in order to accommodate differently sized work pieces (e.g., pipes, fittings, etc.). With reference to FIGS. 3 and 6, the plurality of teeth 34 includes a width $W_2$ extending in a direction between the recessed portions 19, similarly to the width $W_1$, and a length $L_2$ extending parallel to the recessed portions 19, similarly to the length $L_1$. In the illustrated embodiment, the width $W_2$ is about 0.85 inches, which is less than the width $W_1$, and the length $L_2$ is about 1.6 inches. In other embodiments, the width $W_1$ of the plurality of teeth 32 is less than the width $W_2$ of the plurality of teeth 34, and the length $L_2$ may be about one inch to about 1.92 inches. In further embodiments, the widths $W_1$, $W_2$ may be equal. In the illustrated embodiment, the hook jaw 30 includes a threaded portion 54 having a plurality of grooves 56 and defining a longitudinal axis A. The illustrated hook jaw 30 also includes indicia 61 (FIG. 10) to indicate the relative distance 44 between the jaws 28, 30.

Figure 4:
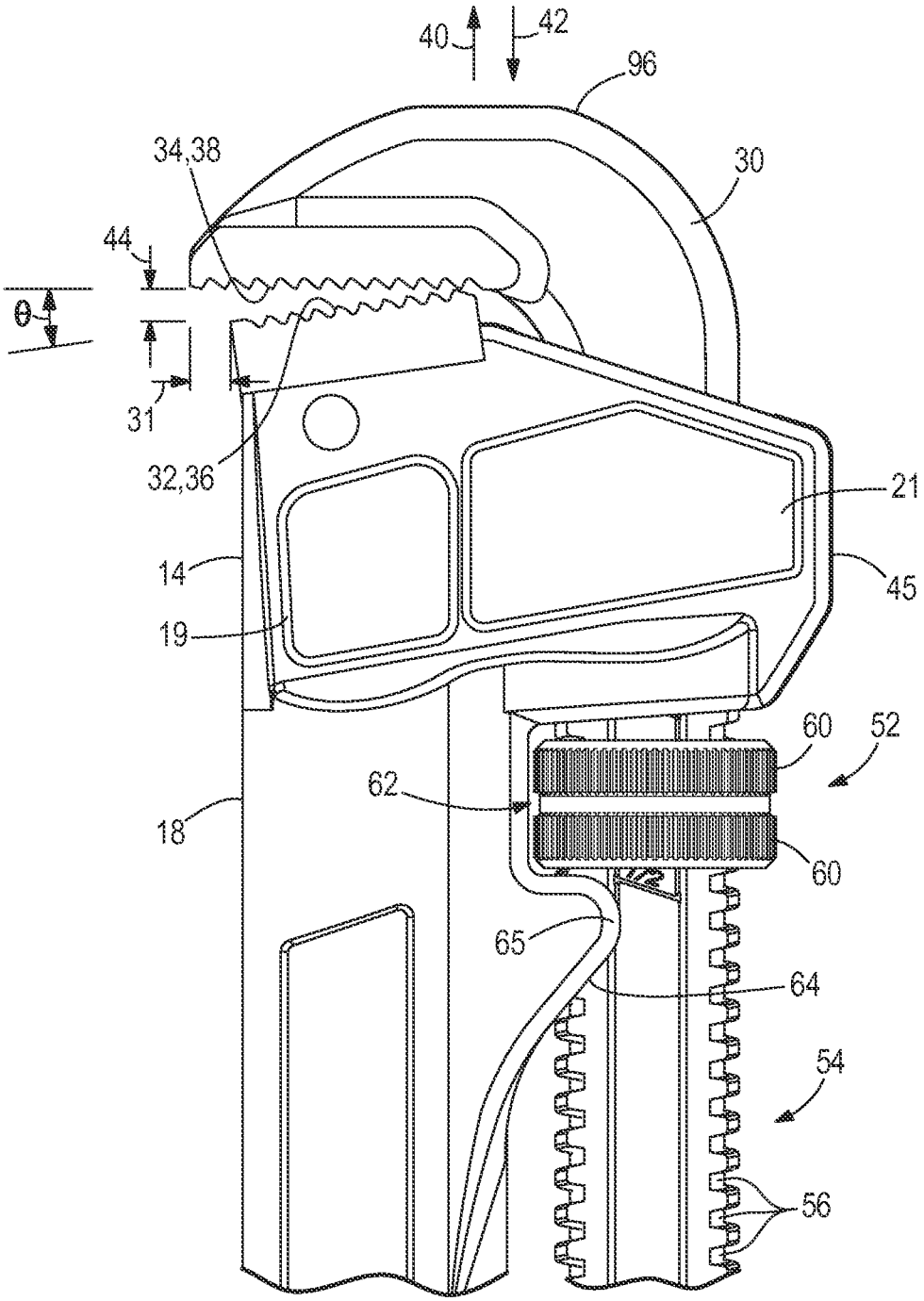
FIG. 4 is a partial side view of the wrench of FIG. 1.

In reference to FIG. 4, the fixed jaw 28 and the hook jaw 30 are orientated such that the hook jaw 30 extends beyond the fixed jaw 28. In particular, the contact region 38 of the hook jaw 30 extends a distance 31, which is perpendicular to the widths $W_1$, $W_2$, past the contact region 36 of the fixed jaw 28. The distance 31 extends parallel to the recessed portions 19 (e.g., side surfaces of the head 14). In other words, the distance 31 extends oppositely from the rear surface of the head 14 defined by the planar surface 45. In the illustrated embodiment, the distance 31 can vary from about ⅛ of an inch to about ½ of an inch. The distance 31 can also vary between different sized of wrenches. For example, a 14 inch wrench may include a different distance 31 than an 18 inch wrench. In addition, the contact region 38 of the hook jaw 30 is orientated at an angle θ relative to the contact region 36 of the fixed jaw 28. With the contact regions 36, 38 orientated at an angle θ, the fixed jaw 28 and the hook jaw 30 are better suited to grip a circular object (e.g., a pipe). In the illustrated embodiment, the angle θ is about 9 degrees. In other embodiments, the angle θ is greater than about 5 degrees and less than about 15 degrees. The angle θ can also vary between different sized of wrenches. For example, a 14 inch wrench may include a different angle θ than an 18 inch wrench.

The wrench 10 further includes an actuator or thumb wheel 52 operable to vary the distance 44 between the jaws 28, 30 and is engaged with the threaded portion 54 of the hook jaw 30. In the illustrated embodiment, the thumb wheel 52 includes a plurality of vertically orientated grooves 60 that are generally parallel to the handle 12. The grooves provide a slip resistant surface to operate the thumb wheel 52. The thumb wheel 52 also includes internal threads 58 that mesh with the grooves 56 to move the hook jaw 30 in the direction of arrow 40 or 42 relative to the fixed jaw 28 in response to rotation of the thumb wheel 52. The thumb wheel 52 is located within a recess 62 formed by the head 14 and flanges 64 projecting from the distal end portion 18 of the handle 12 to prevent the thumb wheel 52 from moving with the hook jaw 30 in the directions of arrows 40 and 42. The flanges 64 are of a robust design to promote durability. A portion of the flanges 64 adjacent the handle 12 include additional material compared to a conventional wrench to inhibit impact fracture of the flanges 64 if the wrench 10 is dropped. In addition, the flanges 64 generally define a curved portion with a radius 65 (FIG. 4). In the illustrated embodiment, the flanges 64 are positioned below the thumb wheel 52. In other embodiments, a portion of the flanges 64 may extend partially within the thumb wheel 52.

Figure 5:
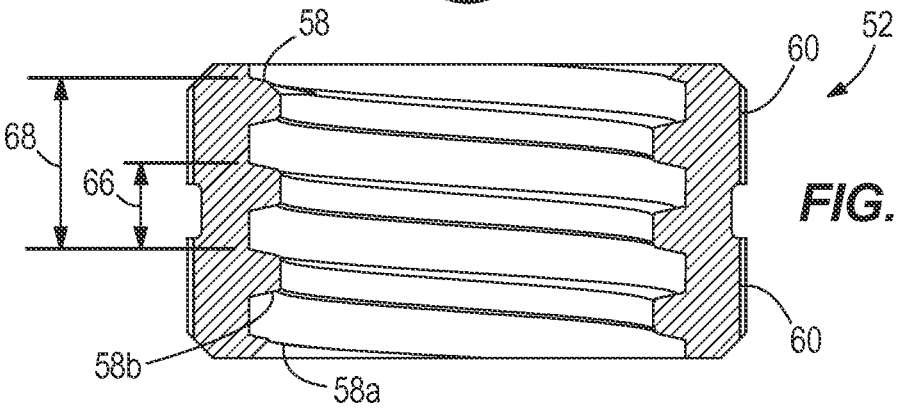
FIG. 5 is a cross-sectional view of a thumb wheel of the wrench of FIG. 1.

With reference to FIG. 5, the thumb wheel 52 is configured as a double-lead thumb wheel 52 (also referred to as a double-start or double-threaded thumb wheel). The threads 58 of the thumb wheel 52 define a pitch distance 66 (referred to hereafter as "pitch") and a lead distance 68 (referred to hereafter as "lead"). The pitch 66 is the axial distance between adjacent crests of the threads 58. The lead 68 is the linear distance that the hook jaw 30 is advanced (in the direction of arrow 40 or 42) for each complete rotation of the thumb wheel 52. A conventionally threaded thumb wheel includes a single thread wrapped helically within the thumb wheel. The pitch 66 and the lead 68 of the conventional thumb wheel are equal; therefore the conventional thumb wheel would advance the hook gear 30 a linear distance equal to the pitch 66 for each complete rotation. In contrast, the illustrated thumb wheel 52 includes two separate threads 58*a* and 58*b*, offset 180 degrees and wrapped helically within the thumb wheel 52. As such, the hook jaw 30 advances twice the pitch 66 per rotation of the thumb wheel 52 (i.e., the lead 68 is twice the pitch 66), thereby requiring less rotation of the thumb wheel 52 to adjust the distance 44 between the jaws 28 and 30.

With reference to FIG. 6, a portion of the threaded portion 54 of the hook jaw 30 is received in an aperture 70 that extends through the head 14. The aperture 70 includes a front wall 72 and a back wall 74 that converge slightly toward each other, being farthest apart at a distal end 76 of the aperture 70. The aperture 70 defines a central axis B being substantially parallel with the handle 12.

Figure 8:
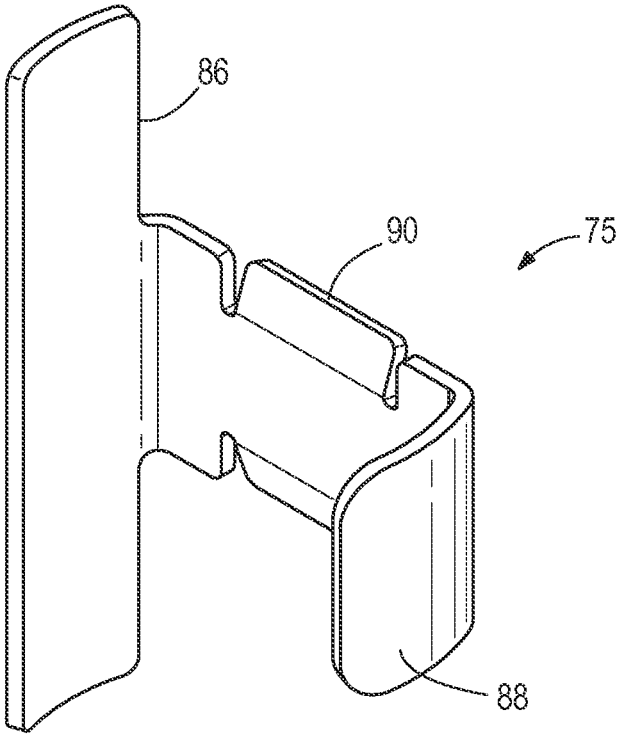
FIG. 8 is a perspective view of a portion of a floating mechanism of the wrench of FIG. 1.

In continued reference to FIG. 6, the wrench 10 includes a floating or biasing mechanism 78 that centers the threaded portion 54 of the hook jaw 30 within the aperture 70 to define a floating position of the hook jaw 30. In other words, the floating mechanism 78 biases the threaded portion 54 in line with the central axis B. In the illustrated embodiment, the floating mechanism 78 includes two coil springs 84 and an intermediate member 75 having a pair of longitudinally extending guide walls 86 and 88 connected by a web 90 (FIG. 8). In the illustrated embodiment, the guide wall 86 is longer than the guide wall 88. In addition, the guide wall 86 is adjacent the front wall 72 as the guide wall 88 is adjacent the back wall 74. The guide walls 86, 88 are located between the coil springs 84 and the hook jaw 30. The coil springs 84 are disposed within corresponding recesses 94 located on the back wall 74 and the front wall 72 with the recesses 94 being offset relative to each other. Stated another way, the coil springs 84 are nonconcentric relative to each other. In the illustrated embodiment, one coil spline 84 is received in one recess 94 on the back wall 74, and one coil spring 84 is received in one recess 94 on the front wall 72. In particular, the coil spring 84 associated with the front wall 72 is positioned closer to the distal end 76 of the aperture 70 along the central axis B than the coil spring 84 associated with the back wall 74. In other embodiments, the coil spring 84 associated with the back wall 74 may be positioned closer to the distal end 76 of the aperture 70 along the central axis B than the coil spring 84 associated with the front wall 72. In further embodiments, there may be more than two coil springs 84. For example, two coil springs may be located on one of the front and the rear walls 72, 74, or two coil springs may be located on both the front and the rear walls 72, 74. The coil springs 84 are deformable to allow a distal end 96 of the hook jaw 30 to move generally in the directions of arrows 98 and 99, to an extent limited by engagement between the hook jaw 30 and the walls 72 and 74.

In addition, the hook jaw 30 includes a thumb release portion 97 (FIG. 1) on an end opposite from the distal end 96. The thumb release portion 97 is generally a flat surface adjacent the threaded portion 54 and the handle 12. As described above, the hook jaw 30 can move in the directions of arrows 98 and 99 by the floating mechanism 78. In addition, the floating mechanism 78 can be manipulated by the thumb release portion 97. For example, a force applied to the thumb release portion 97 towards the handle 12 pivots the hook jaw 30 away from the fixed jaw 28 (in the direction of arrow 99) such that the distance 44 increases.

Figure 9:
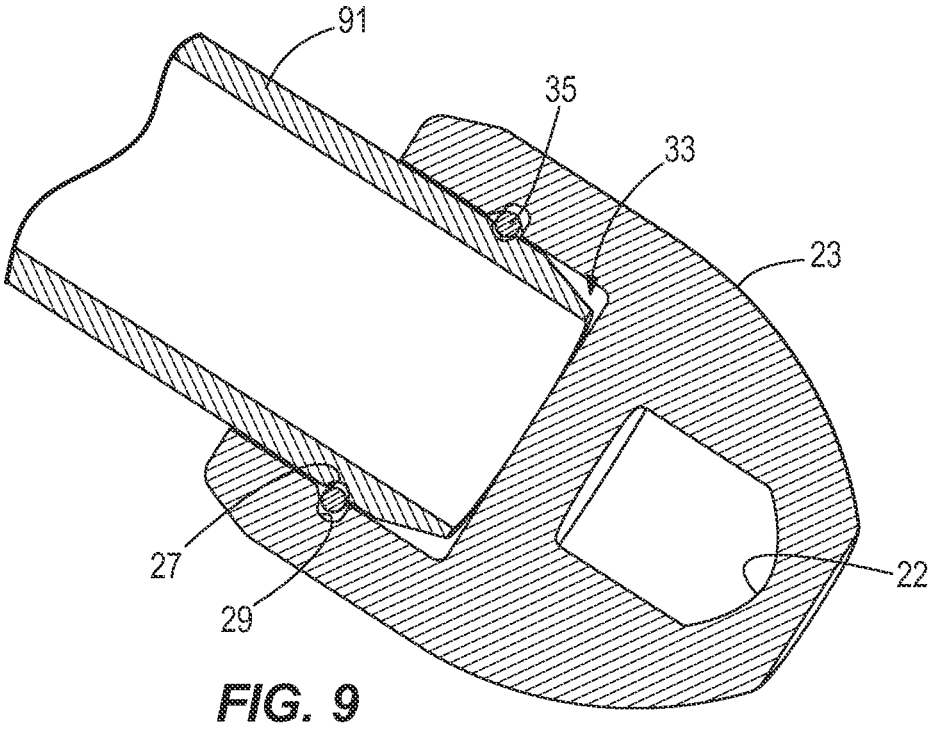
FIG. 9 is a detailed view of an end cap taken along 8-8 of the wrench of FIG. 1.

With reference to FIGS. 1 and 9, an extension member or handle 91 including an end cap 23 is received within the bore 13 to provide additional length to the handle 12. The extension handle 91 is designed with external threads 93 (FIG. 6) such that the extension handle 91 is threadably secured to the threaded portion 15 (FIG. 6) within the bore 13. In addition, the threads of both the extension handle 91 and the bore 13 are designed with a standard National Pipe Thread Taper (NPT). For example, the extension handle 91 includes a ¼ NPT thread configuration. The standard NPT size of the bore 13 provides the operator to couple any extension member to the head 14 with the corresponding NPT size. In other embodiments, the bore 13 is designed to accommodate a different NPT thread configuration (e.g., a ½" diameter, a ⅝" diameter, etc.).

Figure 10:
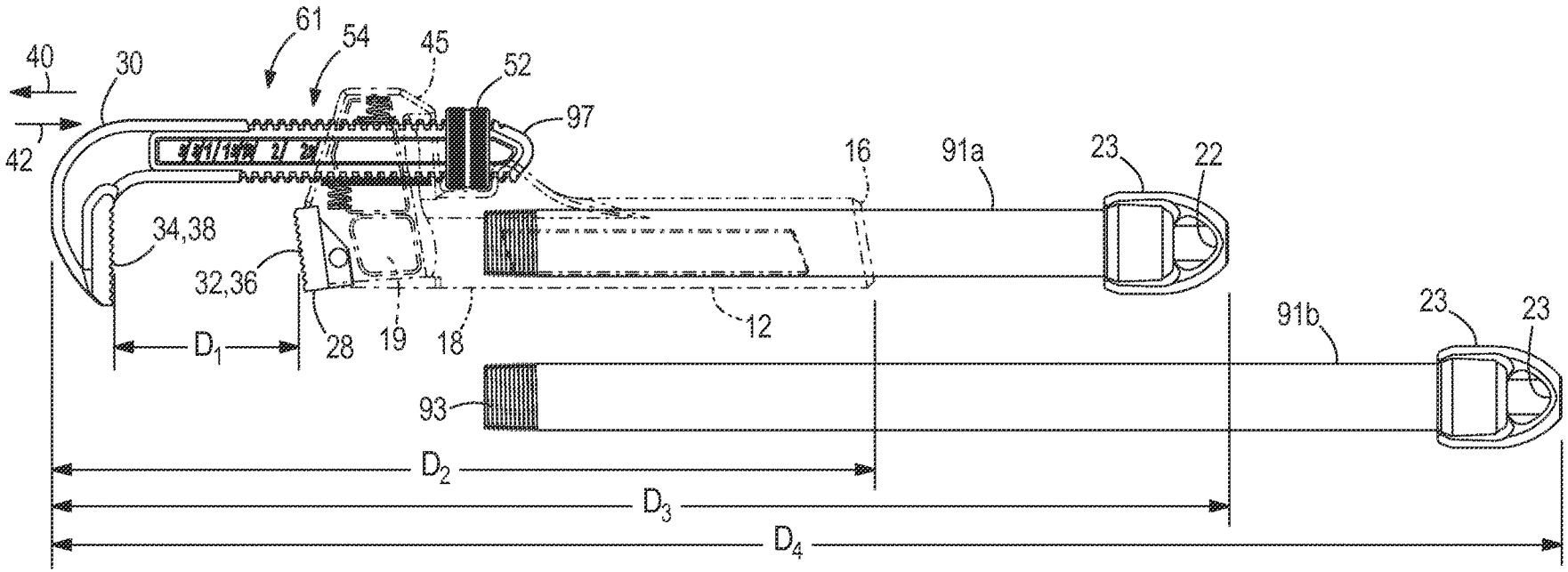
FIG. 10 is a side view of the wrench of FIG. 1 including different extension handle lengths.

The illustrated handle 91 can vary in length to increase leverage of the wrench 10. For example, FIG. 10 illustrates two lengths of the handle 91. In the illustrated embodiment, a total length of a shorter handle 91*a* including the end cap 23 is about 11.8 inches in length, and a total length of a longer handle 91*b* including the end cap 23 is about 17.1 inches in length. In addition, the shorter handle 91*a* includes a length greater than the handle 12. In other embodiments, the handles 91*a*, 91*b* may be any length to provide a desired leverage of the wrench 10.

The illustrated end cap 23 includes a bore 33 having a first radial groove 29 that aligns with a second radial groove 27 formed in the handle 91. A ring member 35 is positioned within the radial grooves 27, 29 such that the end cap 23 can rotate relative to the handle 91, but the end cap 23 is inhibited from axial movement (in the direction of arrows 40, 42) relative to the handle 91. The ring member 35 is defined as a circle spring with a break point such that the ring member 35 extends less than 360 degrees. The ring member 35 is resilient in order to be snapped into and expand within the first radial groove 29 upon assembly of the end cap 23 and the handle 91. In the illustrated embodiment, the ring member 35 is metallic.

In addition, the wrench 10 can be hung (e.g., stored) using an aperture 22 formed through the end cap 23, and the head 14 along with the handle 91 can be rotated for condensed storage and to improve storage of the wrench 10.

In operation, the user can use the wrench 10 to turn a work piece, such as a pipe or fitting. As an operator manipulates the wrench 10, the recessed portions 19, 21 provide better balance, i.e., weight distribution, as well as decreasing the total weight of the wrench 10. To position the wrench 10 about the work piece, the user rotates the thumb wheel 52 to adjust the distance 44 between the jaws 28 and 30. As the user rotates the thumb wheel 52, the meshing between the threads 58 of the thumb wheel 52 and the threaded portion 54 of the hook jaw 30 causes the hook jaw 30 to move in the direction of either arrow 40 or 42, depending on which direction the thumb wheel 52 is rotated. With reference to FIG. 10, a maximum distance D between the teeth 32, 34 can be adjusted to about 3.1 inches, in other embodiments, the distance $D_1$ may vary depending on the size of the wrench 10. With the distance 44 between the jaws 28, 30 slightly larger than the outer diameter of the work piece, the jaws 28 and 30 easily fit onto the work piece because the jaws 28 and 30 do not hind on the work piece. Then, the user further rotates the thumb wheel 52 to reduce the distance 44 between the jaws 28 and 30 until the contact regions 36 and 38 of the jaws 28 and 30 contact the work piece.

With reference to FIG. 6, the floating mechanism 78 holds the hook jaw 30 in a central position between the walls 72 and 74, but permits the distal end 96 of the hook jaw 30 to be moved in the direction of arrow 98 or 99. The hook jaw 30 may thus be accurately positioned to engage the work piece, and when the handle 12 is rotated, the hook jaw 30 tilts within the aperture 70 in the direction of arrow 98 or 99. In addition, the hook jaw 30 can pivot in the direction of arrow 99 by applying a force to the thumb release portion 97. For example, an operator of the wrench 10 can apply force to the thumb release portion 97 by their thumb to increase the distance 44 to easily remove the wrench from a work piece.

In the illustrated embodiment, the wrench 10 is adaptable into multiple sized wrenches. For example, the wrench 10 may be used without the extension handle 91 with the operator gripping the handle 12 between the thumb release portion 97 and the proximal end 16. As such, a total length $D_2$ of the handle 12 with the moveable jaw 30 at the maximum distance $D_1$ is about 13.2 inches. Therefore, a ratio between the width $W_1$ of the jaw 28 and the total length $D_2$ is about 0.07, and a ratio between the width $W_2$ of the jaw 30 and the total length $D_2$ is about 0.06. In other embodiments, the total length $D_2$ may be different by changing the maximum distance $D_1$ and/or by changing the length of the handle 12. The handle 12 is operable by the operator in applications where relatively low torque or leverage is required. Alternatively, the extension handle 91*a* may be coupled to the handle 12 such that a total length $D_3$ of the wrench 10 is about 18.9 inches. Therefore, a ratio between the width $W_1$ of the jaw 28 and the total length $D_3$ is about 0.05, and a ratio between the width $W_2$ of the jaw 30 and the total length $D_3$ is about 0.04. Furthermore, the extension handle 91*b* may be coupled to the handle 12 such that a total length $D_4$ of the wrench 10 is about 24.2 inches. Therefore, a ratio between the width $W_1$ of the jaw 28 and the total length $D_4$ is about 0.04, and a ratio between the width $W_2$ of the jaw 30 and the total length $D_4$ is about 0.03. In other embodiments, the distances $D_3$, $D_4$ may vary depending on the size of the wrench 10.

Figure 11:
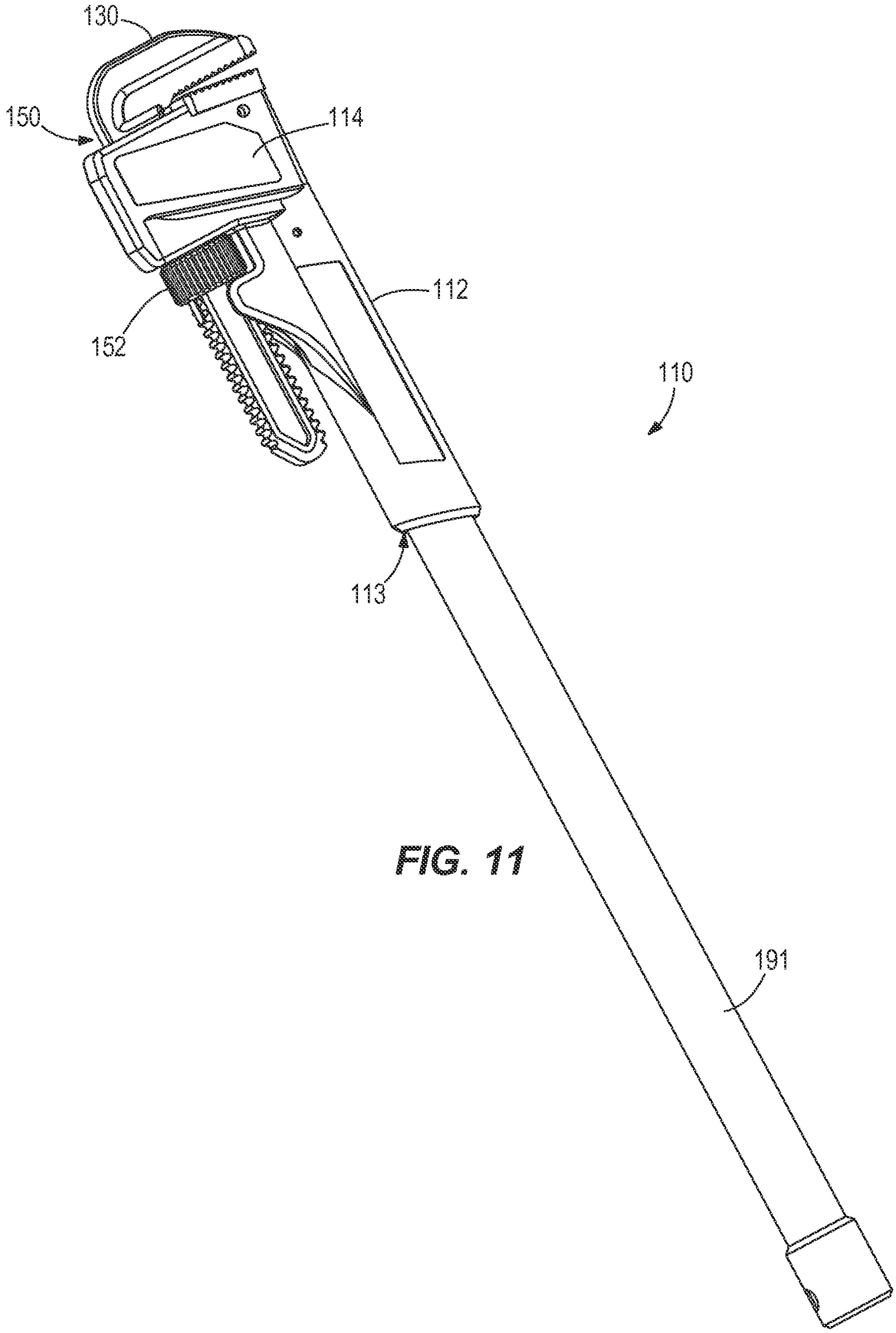
FIG. 11 is a perspective view of a wrench according to another embodiment of the invention.
Figure 12:
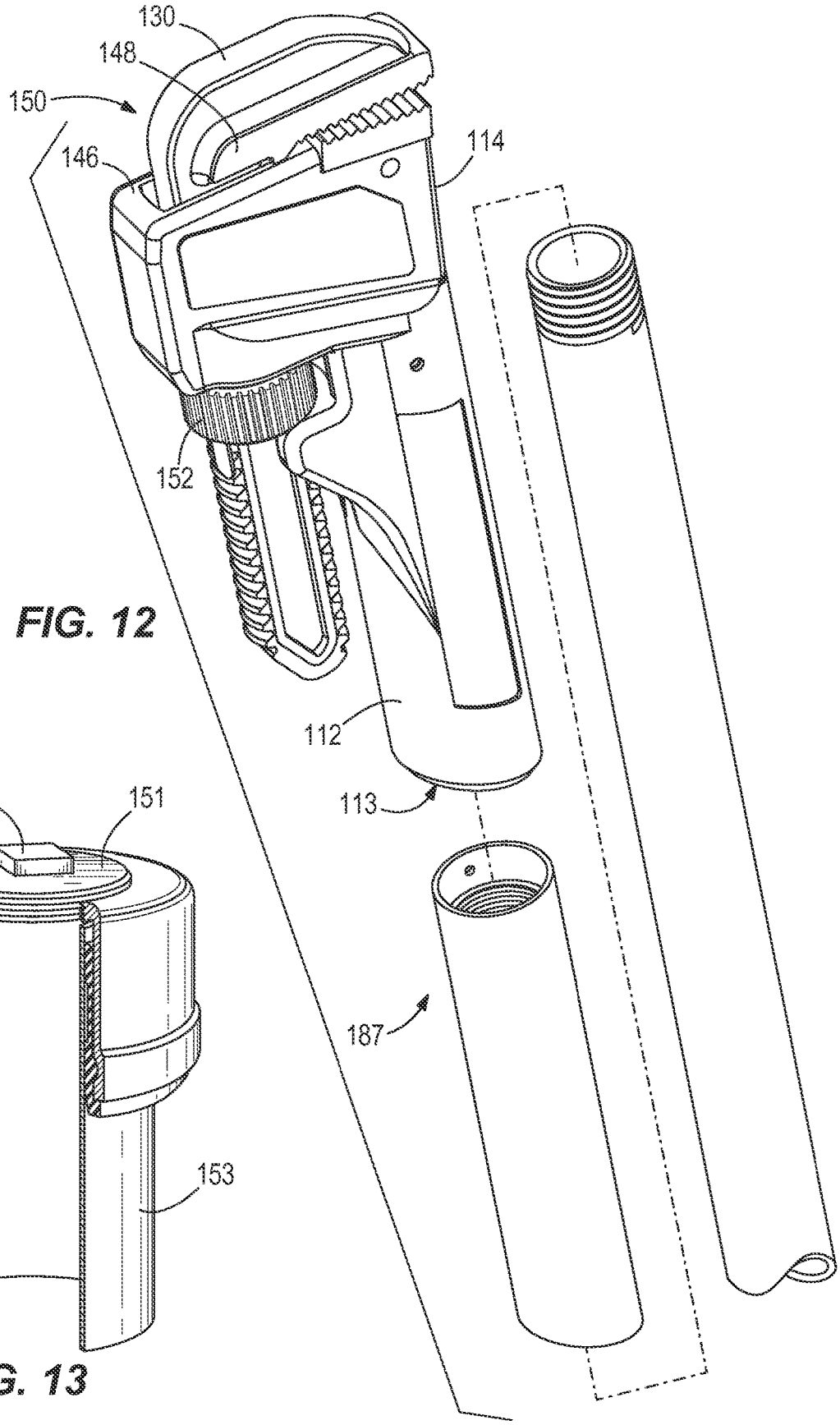
FIG. 12 is a perspective exploded view of the wrench of FIG. 10 including an insert.

FIGS. 11 and 12 illustrate a wrench 110 according to another embodiment of the invention. The wrench 110 is similar to the wrench 10; therefore, like components have been given like reference numbers plus 100 and only differences between the wrenches 10 and 110 will be discussed in detail. In addition, components or features described with respect to only one or some of the embodiments described herein are equally applicable to any other embodiments described herein.

The wrench 110 includes a handle 112, and ultimately a bore 113, manufactured from aluminum. However, an extension handle 191 is manufactured from steel to provide additional strength against torsional forces applied to the extension handle 191 during operation of the wrench 110. Therefore, the operator could potentially strip the internal threads of the bore 113 while tightening the extension handle 191 to the handle 112 due to the weaker aluminum material. As a result, a sleeve 187 defining a hollow cylindrical member is inserted and secured (e.g., press fit, adhesive, etc.) within the bore 113. The sleeve 187 includes internal threads able to engage the external threads of the extension handle 191. The sleeve 187 is also manufactured from steel to inhibit potential damage to the internal threads of the sleeve 187.

Figure 13:
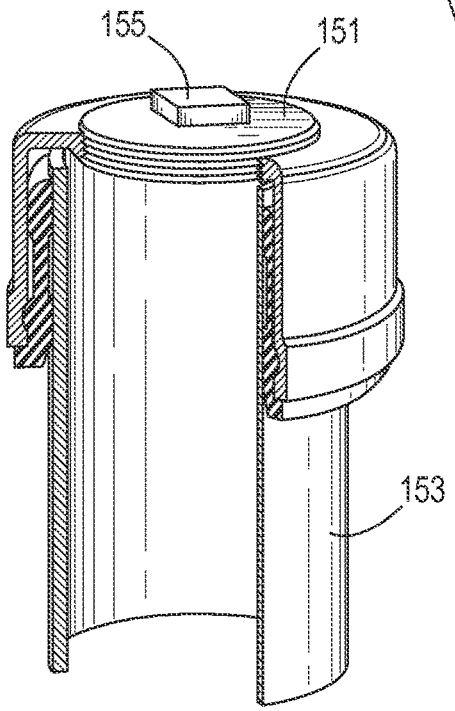
FIG. 13 is a partial cross-sectional view of prior art pipe and cleanout cover.

With reference to FIG. 12, the wrench 110 further includes an auxiliary drive 150 having a first auxiliary drive surface 146 associated with a head 114 of the wrench 110 and a second auxiliary drive surface 148 associated with a hook jaw 130 of the wrench. The illustrated the auxiliary drive 150 is shaped as two parallel surfaces particularly suited to rotate a cleanout cover 151 of a pipe 153 (FIG. 13). In operation, the surfaces 146, 148 receive opposite sides of a square projection 155 of the cover 151 by rotating a thumb wheel 152 to adjust a distance between the surfaces 146, 148. The wrench 110 is then used to rotate the cover 151 relative to the pipe 153 to install or remove the cover 151.

Figure 14:
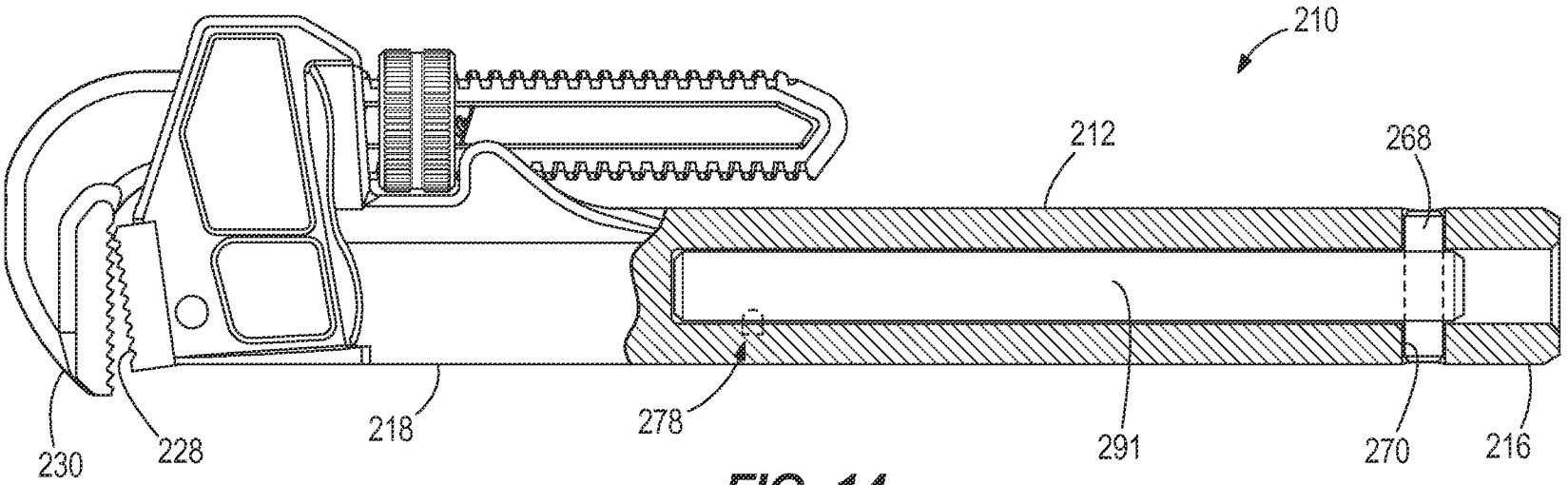
FIG. 14 is a side view of a wrench according to another embodiment of the invention including an extension handle in a stored position.
Figure 15:
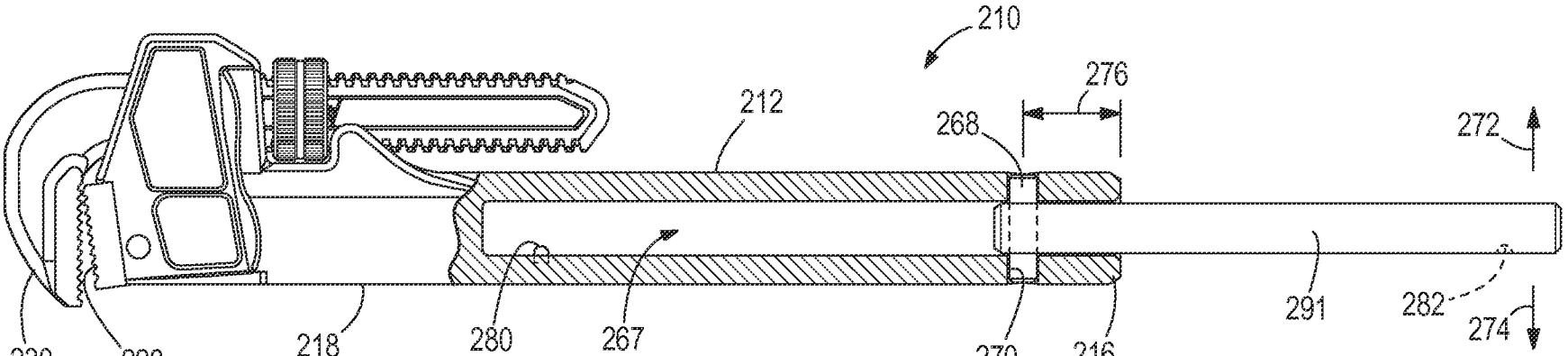
FIG. 15 is a side view of the wrench of FIG. 13 with the extension handle in an extended position.

FIGS. 14 and 15 illustrate a wrench 210 according to another embodiment of the invention. The wrench 210 is similar to the wrench 10; therefore, like components have been given like reference numbers plus 200 and only differences between the wrenches 10 and 210 will be discussed in detail. In addition, components or features described with respect to only one or some of the embodiments described herein are equally applicable to any other embodiments described herein.

The wrench 210 includes an extension member 291 pivotally coupled to a handle 212 via a pin 268. In addition, the wrench 210 includes a recess 267 (FIG. 15) able to receive the extension member 291 within the handle 212. The pin 268 is received within an aperture 270 adjacent a proximal end portion 216. In a storage position (FIG. 14), the extension member 291 is generally disposed between the proximal end portion 216 and a distal end portion 218. In an extended position (FIG. 15), the extension member 291 extends beyond the proximal end portion 216. The extension member 291 can include a range of cross sectional geometries (e.g., square, circle, rectangle, etc.).

The extension member 291 of the handle 212 is selectively pivotable between the storage position and the extended position to increase the amount of leverage to jaws 228, 230. In the extended position, the extension member 291 and the handle 212 form an overlapping area 276 such that the extension member 291 is not moveable relative to the handle 212 in the direction defined by direction arrows 272, 274.

In addition, the wrench 210 includes a detent mechanism 278 to inhibit pivoting motion of the extension member 291. The detent mechanism 278 includes a detent protrusion 280 located on the handle 212 and a detent aperture 282 located on the extension member 291. The detent protrusion 280 and the detent aperture 282 are located the same distance from the pin 268 such that the detent aperture 282 is engaged with the detent protrusion 280 to temporarily lock the extension member 291 in the storage position. In another embodiment, the detent protrusion 280 may be located on the extension member 291 and the detent aperture 282 may be located on the handle 212.

Figure 16:
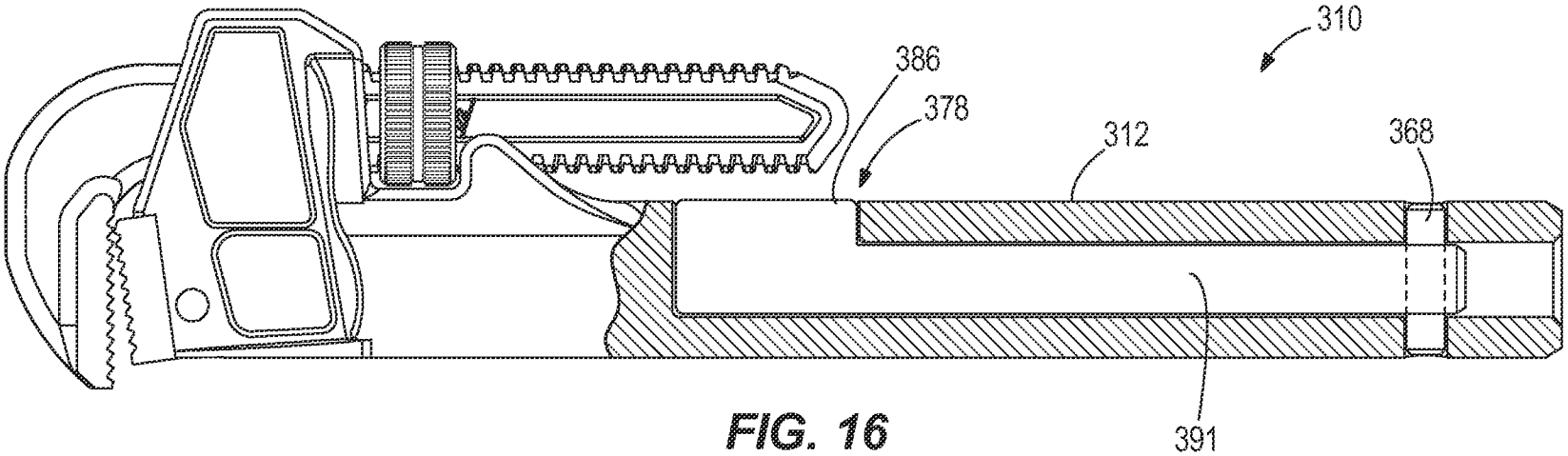
FIG. 16 is a side view of a wrench according to another embodiment of the invention including an extension handle in a stored position.
Figure 17:
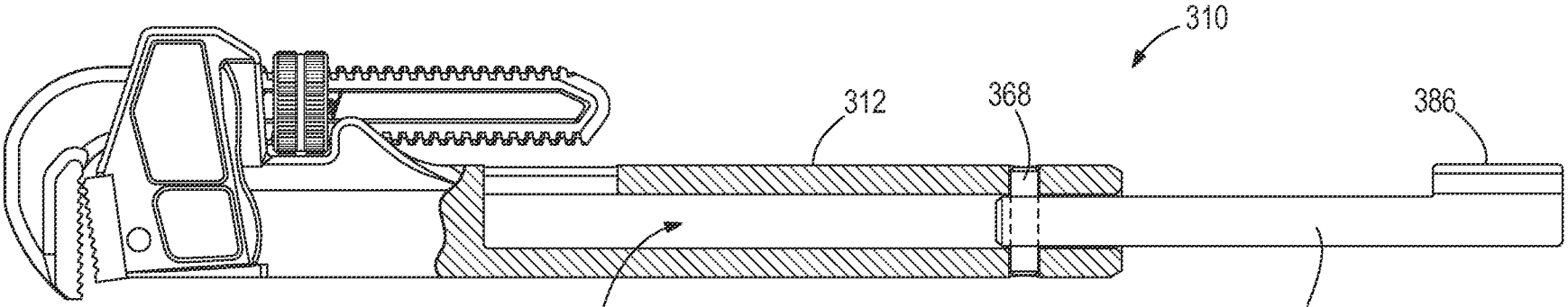
FIG. 17 is a side view of the wrench of FIG. 15 with the extension handle in an extended position.
Figure 18:
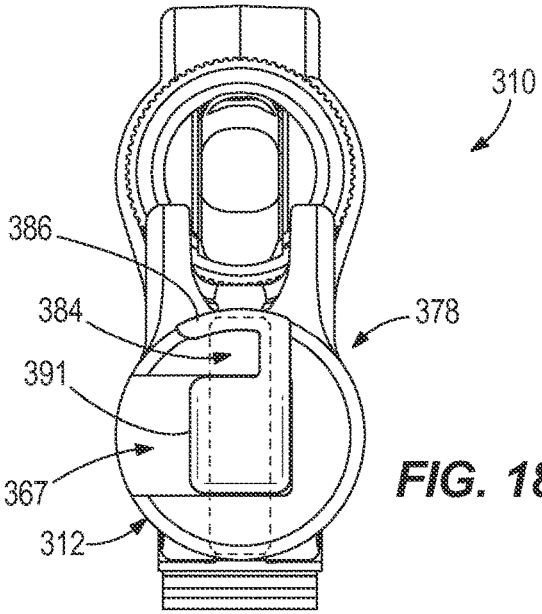
FIG. 18 is a rear view of the wrench of FIG. 16.

FIGS. 16-18 illustrate a wrench 310 according to another embodiment of the invention. The wrench 310 is similar to the wrench 10; therefore, like components have been given like reference numbers plus 300 and only differences between the wrenches 10 and 310 will be discussed in detail. In addition, components or features described with respect to only one or some of the embodiments described herein are equally applicable to any other embodiments described herein.

The extension member 391 includes a hook and recess mechanism 378. The hook and recess mechanism 378 includes an arm 386 that extends over a top portion of a handle 312 in a storage position (FIG. 16) to temporarily lock the hook mechanism 378 in the storage position. In particular, a recess 367 of the handle 312 receives the extension member 391 in the storage position. The illustrated extension member 391 is pivotable about a pin 368 into an extended position (FIG. 17). A rear view of the wrench 310 is illustrated in FIG. 18 with the extension member 391 in the extended position. The hook and recess mechanism 378 includes a cavity 384 that is able to receive a side portion of the handle 312 when the extension member 391 is in the storage position.

Figure 19:
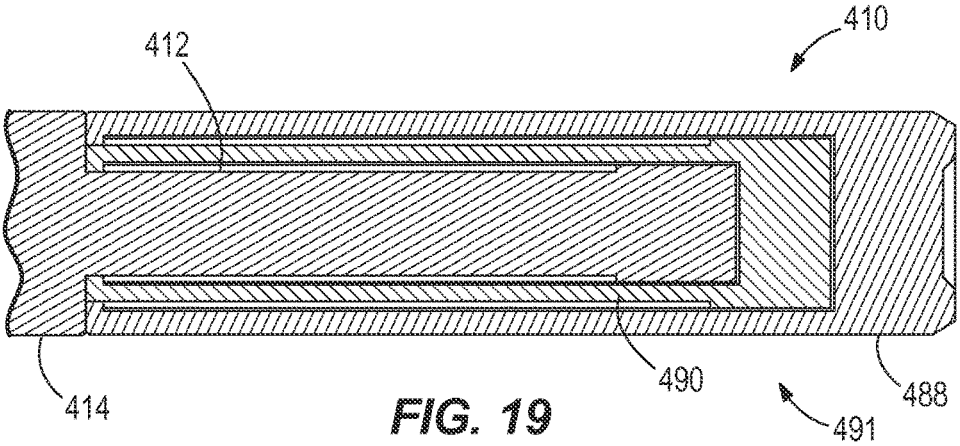
FIG. 19 is a partial side view of a handle of a wrench according to another embodiment of the invention including an extension handle in a stored position.
Figure 20:
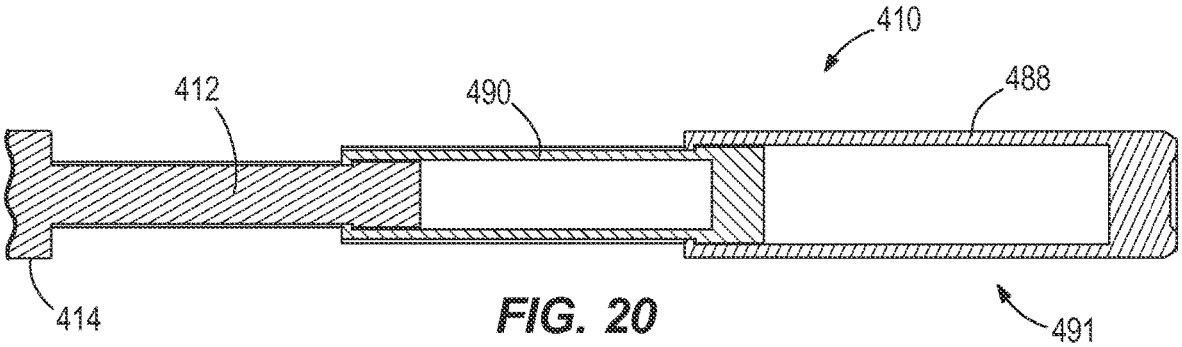
FIG. 20 is a partial side view of the handle of the wrench of FIG. 18 with the extension handle in an extended position.

FIGS. 19 and 20 illustrate a wrench 410 according to yet another embodiment of the invention. The wrench 410 is similar to the wrench 10; therefore, like components have been given like reference numbers plus 400 and only differences between the wrenches 10 and 410 will be discussed in detail. In addition, components or features described with respect to only one or some of the embodiments described herein are equally applicable to any other embodiments described herein.

The extension member 491 includes an outer extension member 488 that is slidably received over an inner extension member 490. In addition, the inner extension member 490 is slidably received over a handle 412. In the storage position (FIG. 19), the outer extension member 488 and the inner extension member 490 abut a head 414 of the wrench 410. To move the extension member 491 to an extended position (FIG. 20), the user slides the outer extension member 488 relative to the inner extension member 490, and the inner extension member 490 slides relative to the handle 412 away from the head 414. In other embodiments, to move the extension member 491 from the storage position into an extended position, the user may only slide the outer extension member 488 relative to the inner extension member 490 and the handle 412. In further embodiments, to move the extension member 491 from the storage position into an extended position, the user may slide the outer extension member 488 with the inner extension member 490 relative to the handle 412.

Figure 21:
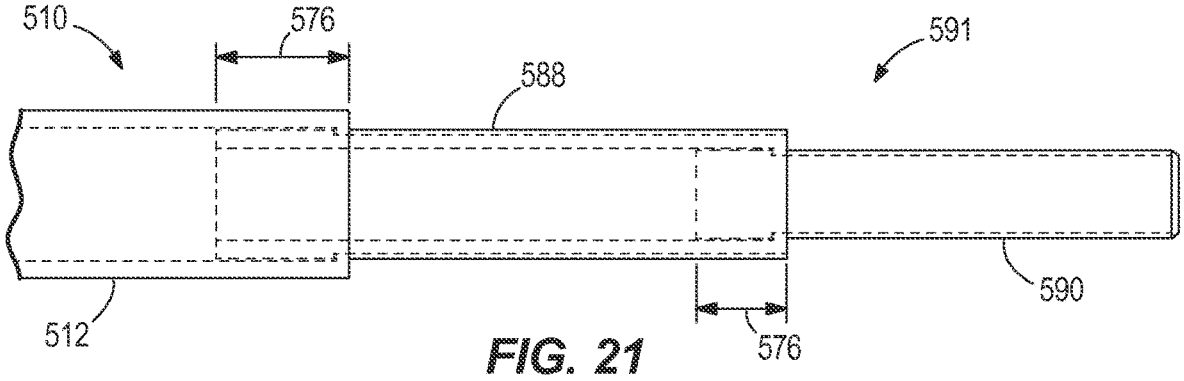
FIG. 21 is a partial side view of a handle of a wrench according to another embodiment of the invention including an extension handle.

FIG. 21 illustrates a wrench 510 according to yet another embodiment of the invention. The wrench 510 is similar to the wrench 10; therefore, like components have been given like reference numbers plus 500 and only differences between the wrenches 10 and 510 will be discussed in detail. In addition, components or features described with respect to only one or some of the embodiments described herein are equally applicable to any other embodiments described herein.

The illustrated wrench 510 includes an extension member 591 including an inner extension member 590 that is slidably received within an outer extension member 588 and the outer extension member 588 is slidably received within a handle 512. In the illustrated embodiment, the inner extension member 590 extends from the outer extension member 588 about 5 inches. The outer extension member 588 is substantially hollow and the outer extension member 588 extends from the handle 512 about 4 inches. In sum, the extension member 591 extends about 9 inches from the handle 512 in the extended position. In addition, the wrench 510 includes two overlapping areas 576. In the illustrated embodiment, the overlapping area 576 between the handle 512 and the outer extension member 588 is about 2 inches and the over lapping area 576 between the outer extension member 591 and the inner extension member 590 is about 1 inch. In other embodiments, the extension member 591 may include varying dimensions of the outer and the inner extension members 588, 590 and the overlapping areas 576 to account for varying wrench 510 sizes.

Figure 22:
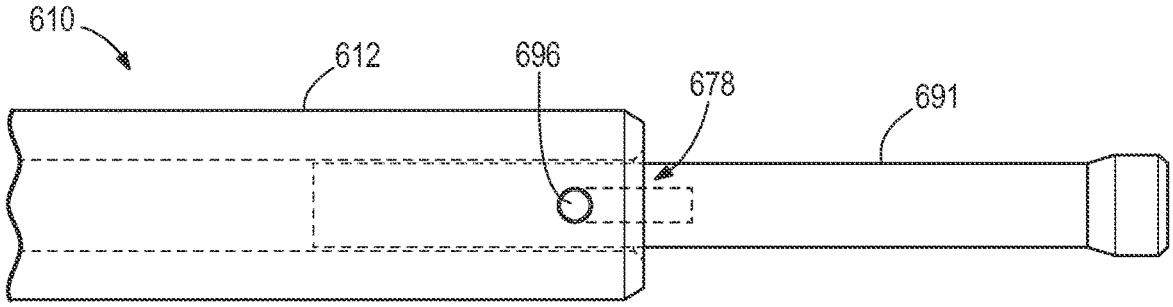
FIG. 22 is a partial side view of a handle of a wrench according to another embodiment of the invention including an extension handle.

FIG. 22 illustrates a wrench 610 according to yet another embodiment of the ration. The wrench 610 is similar to the wrench 510; therefore, like components have been given like reference numbers plus 100 and only differences between the wrenches 510 and 610 will be discussed in detail. In addition, components or features described with respect to only one or some of the embodiments described herein are equally applicable to any other embodiments described herein.

The illustrated wrench 610 includes a detent mechanism 678 having a positive lock button 696 coupled to an extension member 691. The positive lock button 696 protrudes outwardly from the extension member 691 and is biased by a spring. A cavity 698 is located on an inner surface of a handle 612 that receives the positive lock button 696 in an extended position. In another embodiment, the positive lock button 696 may be coupled to the handle 612 and the cavity 698 may be located on the extension member 691. To remove the extension member 691 from the handle 612, the positive lock button 696 is depressed towards the extension member 691 such that the positive lock button 696 is able to slide within the cavity 698.

Figure 23:
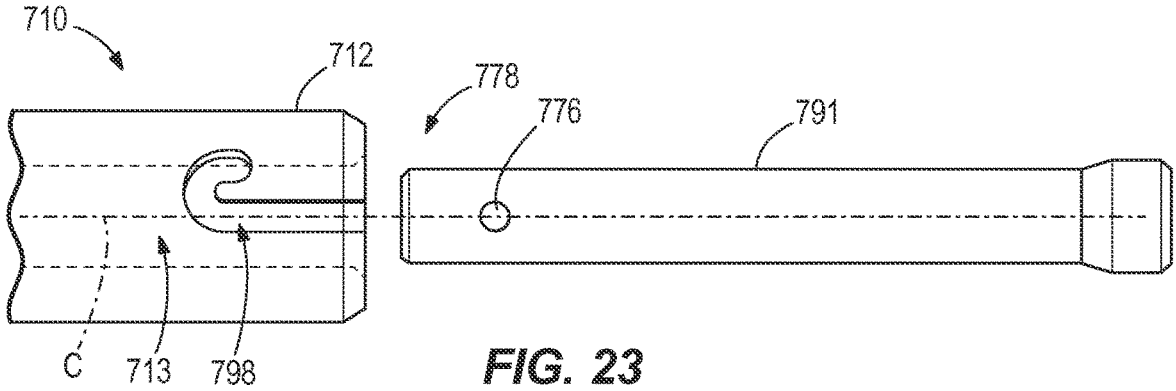
FIG. 23 is a partial side view of a handle of a wrench according to another embodiment of the invention including an extension handle.

FIG. 23 illustrates a wrench 710 according to another embodiment of the invention. The wrench 710 is similar to the wrench 10; therefore, like components have been given like reference numbers plus 700 and only differences between the wrenches 10 and 710 will be discussed in detail. In addition, components or features described with respect to only one or some of the embodiments described herein are equally applicable to any other embodiments described herein.

The illustrated wrench 710 includes a detent mechanism 778. The handle 712 includes a bore 713 extending into the handle 712, and the bore 713 includes a cavity 798 located near a proximal end portion 716 of the handle 712. The cavity 798 extends around an inner circumference of the bore 713 in a direction generally perpendicular to a longitudinal axis C. An extension member 791 includes a positive lock button 796 that are inserted into the bore 713 such that the positive lock button 796 is received within the cavity 798. The extension handle 791 is rotated relative to the handle 712 to lock the positive lock button 796 into a portion of the cavity 798. As a result, the extension handle 791 is secured to the handle 712 in an extended position.

Figure 24:
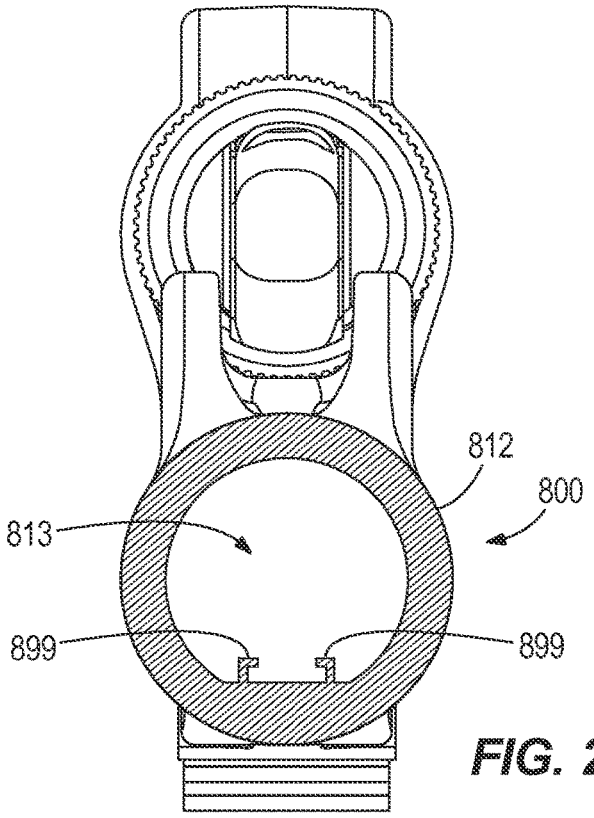
FIG. 24 is a cross-sectional view of a non-rotational feature of a wrench.

FIG. 24 illustrates a cross section of a non-rotational feature 800 located within a bore 813 of a handle 812 and is applicable to wrenches 410, 510, 610. More generally, the non-rotational feature 800 may be utilized in a wrench including a sliding linear engagement between an extension member and a handle. In addition, the non-rotational feature 800 includes guide rails 899 that guide linear movement between two members (i.e., extension member and handle or inner extension member and outer extension member) yet inhibit rotational movement between two members.

Figure 25:
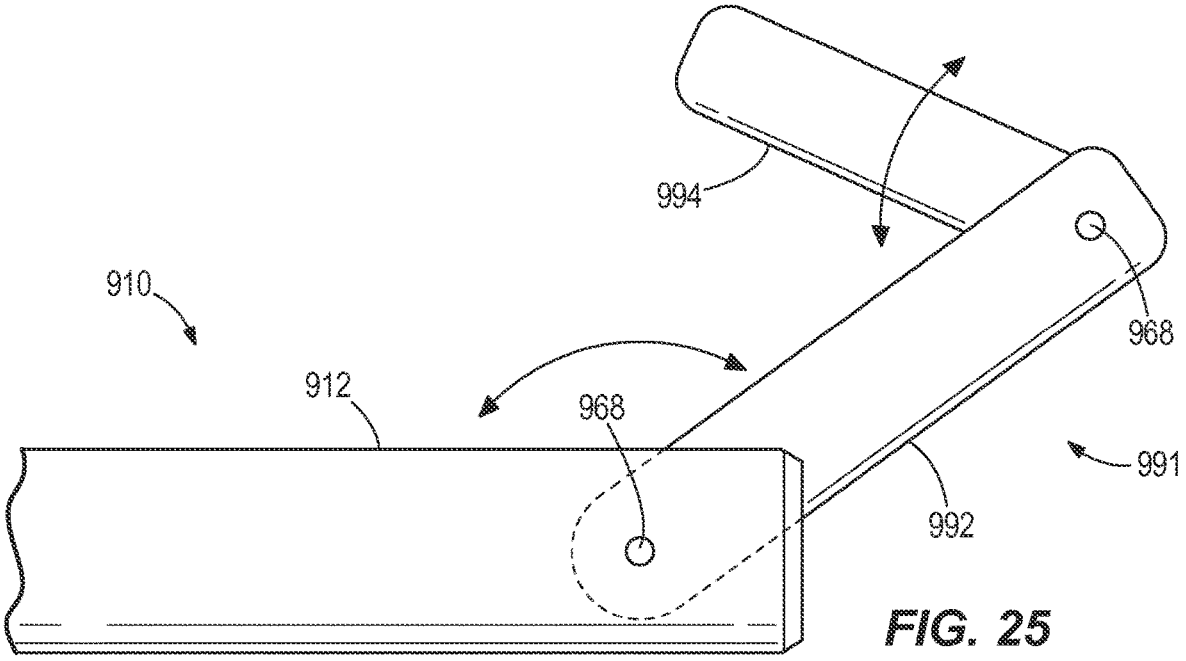
FIG. 25 is a partial side view of a handle of a wrench according to another embodiment of the invention.

FIG. 25 illustrates a wrench 910 according to yet another embodiment of the invention. The wrench 910 is similar to the wrench 10; therefore, like components have been given like reference numbers plus 900 and only differences between the wrenches 10 and 910 will be discussed in detail. In addition, components or features described with respect to only one or some of the embodiments described herein are equally applicable to any other embodiments described herein.

The illustrated wrench 910 includes an extension member 991 having a first extension member 992 and a second extension member 994. The first extension member 992 is pivotably coupled to a handle 912 via a pin 968, and the second extension member 994 is pivotably coupled to the first extension member 992 via a pin 968. To move the extension member 991 to a storage position (not shown), the second extension member 994 is rotated into the first extension member 992 and the first extension member 992 is rotated into the handle 912 such that the extension member 991 is disposed within the handle 912. To move the extension member 991 to an extended position (not shown), the opposite sequence is performed. For example, the first extension member 992 is rotated out of the handle 912, and then the second extension member 994 is rotated out of the first extension member 992 so that the extension member 991 is substantially parallel with the handle 912.

Although the invention has been described in detail with reference to certain preferred embodiments, variations and modifications exist within the scope and spirit of one or more independent aspects of the invention as described.

The invention claimed is:

1. A pipe wrench comprising:

a head including an aperture;

a first jaw coupled to the head, the first jaw including a plurality of teeth that define a first contact region;

a second jaw partially extending through the aperture of the head, the second jaw including a threaded portion and a plurality of teeth that define a second contact region, the second contact region extending beyond the first contact region in a direction parallel to side surfaces of the head, the second contact region defining a width;

an actuator including threads engaged with the threaded portion of the second jaw such that rotation of the actuator moves the second contact region of the second jaw relative to the first contact region of the first jaw;

a handle including a proximal end portion and a distal end portion, the distal end portion adjacent the head and the proximal end portion opposite the distal end portion, the proximal end portion including a bore;

a first extension handle removably coupled within the bore; and a second extension handle defining a length extending from an end of the second extension handle to an end of the second jaw, wherein a ratio of the width of the second contact region and the length is less than about 0.04, the second extension handle removably coupled within the bore.

2. The pipe wrench of claim 1, wherein the width of the second contact region is about 0.9 inches.

3. The pipe wrench of claim 2, wherein the length extending from an end of the second extension handle to an end of the second jaw is about 19 inches.

4. The pipe wrench of claim 2, wherein the length extending from an end of the second extension handle to an end of the second jaw is about 24 inches.

5. The pipe wrench of claim 1, wherein the second contact region extends about ⅛ of an inch to about ½ of an inch beyond the first contact region.

6. The pipe wrench of claim 1, wherein the first contact region defines a width, wherein the width of the second contact region is less than the width of the first contact region.

7. The pipe wrench of claim 1, wherein the first contact region defines a length and the second contact region defines a length, wherein the length of the second contact region is greater than the length of the first contact region such that the second jaw extends beyond the first jaw.

8. A pipe wrench comprising:

a head including an aperture;

a first jaw coupled to the head, the first jaw including a plurality of teeth that define a first contact region;

a second jaw partially extending through the aperture of the head, the second jaw including a threaded portion and a plurality of teeth that define a second contact region, the second contact region defining a length between 1 inch to about 1.8 inches;

an actuator including threads engaged with the threaded portion of the second jaw such that rotation of the actuator moves the second contact region of the second jaw relative to the first contact region of the first jaw;

a handle including a proximal end portion and a distal end portion, the distal end portion adjacent the head and the proximal end portion opposite the distal end portion, the proximal end portion including a bore;

a first extension handle defining a first length selectively coupled within the bore; and a second extension handle defining a second length extending from an end of the second extension handle to an end of the second jaw, wherein the second length is between 18.9 inches and 24.2 inches, the second extension handle selectively coupled within the bore;

wherein the handle is integrally formed with the head as a single component and the aperture is defined through the single component.

9. The pipe wrench of claim 8, wherein the handle defines a third length, and wherein the third length of the handle is less than the first length of the first extension handle and the second length of the second extension handle.

10. The pipe wrench of claim 8, wherein the bore includes a first end, a second end, a threaded portion positioned closer to the first end than the second end, and a non-threaded portion positioned closer to the second end than the first end, and wherein the first and second extension handles include a threaded portion received through the non-threaded portion of the bore before engaging the threaded portion of the bore.

11. The pipe wrench of claim 8, further comprising a first end cap rotatably coupled to the first extension handle such that the first end cap is axially fixed relative to the first extension handle.

12. The pipe wrench of claim 11, further comprising a second end cap rotatably coupled to the second extension handle such that the second end cap is axially fixed relative to the second extension handle.

* * * * *